US007334663B2

(12) United States Patent
Nakayama et al.

(10) Patent No.: US 7,334,663 B2
(45) Date of Patent: Feb. 26, 2008

(54) VARIABLE RESONATOR

(75) Inventors: Tatsuya Nakayama, Tokyo (JP); Mikihiko Suzuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 192 days.

(21) Appl. No.: 11/338,716

(22) Filed: Jan. 25, 2006

(65) Prior Publication Data

US 2007/0023230 A1 Feb. 1, 2007

(30) Foreign Application Priority Data

Jul. 27, 2005 (JP) ..... 2005-217045

(51) Int. Cl.

| | |
|---|---|
| ***F01N 1/02*** | (2006.01) |
| ***F01N 1/12*** | (2006.01) |
| ***F02M 35/12*** | (2006.01) |
| *F01N 1/08* | (2006.01) |
| *F02M 35/10* | (2006.01) |
| *F02M 35/14* | (2006.01) |

(52) U.S. Cl. ..... 181/276; 181/273; 181/266; 181/250; 123/184.57; 123/184.55

(58) Field of Classification Search ..... 181/276, 181/277, 278, 273, 271, 266, 250, 241, 216, 181/219; 123/184.57, 184.55, 184.53
See application file for complete search history.

(56) References Cited

U.S. PATENT DOCUMENTS 4,546,733 A * 10/1985 Fukami et al. ..... 123/184.57
5,283,398 A * 2/1994 Kotera et al. ..... 181/224
5,317,112 A * 5/1994 Lee ..... 181/250
5,771,851 A * 6/1998 McLean ..... 123/184.57
5,930,371 A * 7/1999 Cheng et al. ..... 381/71.5
6,508,331 B1 * 1/2003 Stuart ..... 181/250
6,732,509 B2 * 5/2004 Shiga ..... 60/312
6,792,907 B1 * 9/2004 Kostun et al. ..... 123/184.57
6,848,410 B2 * 2/2005 Hoffmann et al. ..... 123/184.57
7,077,093 B2 * 7/2006 Koelmel et al. ..... 123/184.57

(Continued)

FOREIGN PATENT DOCUMENTS

DE 4137704 A1 * 5/1993

(Continued)

*Primary Examiner*—Edgardo San Martin
(74) *Attorney, Agent, or Firm*—Sughrue Mion, PLLC

(57) ABSTRACT

A communicating pipe is disposed on an outer periphery of an air intake pipe, and a conduit is formed so as to be parallel to an air intake passage. A plurality of first communicating apertures are disposed through the air intake pipe so as to be arranged in a single row in a conduit direction and communicate between the conduit and the air intake passage. A resonance chamber is mounted to the communicating pipe so as to communicate with a first end of the conduit. A movable member is disposed so as to be movable in the conduit direction by sliding in contact with the inner wall surface of the communicating pipe. A second communicating aperture is disposed through the movable member so as to be placed above the first communicating apertures. A communicating channel length between the air intake passage and the resonance chamber is adjusted by changing a position of overlap of the second communicating aperture relative to the first communicating apertures by moving the movable member in the conduit direction.

4 Claims, 2 Drawing Sheets

U.S. PATENT DOCUMENTS

| | | | | |
|---|---|---|---|---|
| 7,089,901 | B2 * | 8/2006 | Kino et al. | 123/184.57 |
| 7,255,197 | B2 * | 8/2007 | Horiko | 181/250 |
| 2005/0199439 | A1 * | 9/2005 | Goenka et al. | 181/250 |
| 2006/0086564 | A1 * | 4/2006 | Kostun et al. | 181/250 |

FOREIGN PATENT DOCUMENTS

| | | | |
|---|---|---|---|
| JP | 59-105958 | A | 6/1984 |
| JP | 07-55321 | Y2 | 12/1995 |
| JP | 09291812 | A * | 11/1997 |

* cited by examiner

VARIABLE RESONATOR

BACKGROUND OF THE INVENTION

1. Field of the Invention

The present invention relates to a variable resonator capable of reducing noise due to air intake noise originating from an engine of an automobile, etc., over a wide operating range.

2. Description of the Related Art

Conventional resonators are configured such that a tubular member branches off perpendicularly from an air intake duct, and an end surface of the tubular member opens onto a resonance chamber.

In conventional resonators configured in this manner, since the length of a communicating channel between the air intake duct and the resonance chamber is constant, resonance frequencies are fixed uniformly, and damping effects can be achieved only at those specific resonance frequencies.

If an attempt is made to handle a wide range of frequencies of air intake noise that change over a wide operating range from low speeds to high speeds using conventional resonators of this kind, it is necessary to provide a plurality of resonators manufactured so as to have different resonance frequencies by changing the length of the communicating channel between the air intake duct and the resonance chamber, and one problem has been that installation space in the engine compartment is increased thereby.

In view of these conditions, a first variable resonator has been proposed that is configured such that an outer tubular member is branched off perpendicularly from an air intake duct, an end surface of the outer tubular member opens onto a resonance chamber, and an inner tubular member is disposed slidably along an inner wall of the outer tubular member. (See Patent Literature 1, for example.) In this first conventional variable resonator, the resonance frequencies are made variable by sliding the inner tubular member along the inner wall of the outer tubular member so as to change the amount of inner tubular member projecting outward from the outer tubular member, in other words so as to change the length of the communicating channel between the air intake duct and the resonance chamber.

A second variable resonator has also been proposed that includes: a case body having a resonating portion communicating with an air intake duct through a tubular neck portion, the resonating portion being formed so as to have a circular container shape aligned with the neck portion; a cylindrical fixed tube fixed concentrically inside the case body and connecting to the neck portion an annular passage formed between the case body and the fixed tube; and a movable member moving through the annular passage by sliding in contact with an inner peripheral surface of the case body and an outer peripheral surface of the fixed tube. (See Patent Literature 2, for example.) In this second conventional variable resonator, the neck portion is made to communicate inside the fixed tube through the annular passage by arranging a plurality of communicating apertures circumferentially on the fixed tube. Thus, the resonance frequencies are made variable by opening and closing the communicating apertures of the fixed tube by sliding the movable member so as to change the length of the communicating channel between the air intake duct and the fixed tube.

Patent Literature 1: Japanese Patent Laid-Open No. SHO 59-105958 (Gazette)

Patent Literature 2: Japanese Utility Model Laid-Open No. HEI 03-89975 (Gazette)

In the first conventional variable resonator, the length of the communicating channel between the air intake duct and the resonance chamber is changed by moving the inner tubular member rectilinearly in a direction perpendicular to the air intake duct so as to change the amount of inner tubular member projecting outward from the outer tubular member. Thus, in order to widen the range of resonance frequencies, it is necessary to increase installation space for the resonator to allow for a long range of movement of the inner tubular member, and interference with other parts has been a problem.

In the second conventional resonator, because it is necessary to form the resonating portion so as to have a circular shape, one problem has been that the shape of the resonating portion cannot be changed to avoid interference with other parts, placing constraints on layout.

SUMMARY OF THE INVENTION

The present invention aims to solve the above problems and an object of the present invention is to provide a variable resonator capable of ensuring a wide resonance frequency range relative to air intake noise without having to allow for space to accommodate changes in communicating channel length and also without imposing constraints on resonance chamber shape.

In order to achieve the above object, according to one aspect of the present invention, there is provided a variable resonator including: a communicating pipe disposed on an outer periphery of an air intake pipe constituting an air intake passage of an engine, the communicating pipe having a conduit formed in an internal portion thereof so as to lie alongside an outer peripheral wall surface of the air intake pipe; a resonance chamber mounted to the communicating pipe so as to communicate with a first end of the conduit; and a first communicating aperture disposed through the air intake pipe so as to communicate between the air intake passage and the conduit such that a plurality of the first communicating apertures are arranged in a single row in a conduit direction of the communicating pipe or such that the first communicating aperture extends in the conduit direction. The variable resonator further includes a movable member formed so as to have a tubular body having a movable passage extending from a second communicating aperture formed on a side wall to a first end opening, the movable member being disposed such that the side wall on which the second communicating aperture is formed faces the air intake pipe, such that the first end opening faces the first end of the conduit, and so as to be movable through the conduit in the conduit direction by sliding in contact with an inner wall surface of the communicating pipe. A communicating channel length between the air intake passage and the resonance chamber is adjusted by changing a position of overlap of the second communicating aperture relative to the first communicating aperture by moving the movable member in the conduit direction so as to change a communicating position between the air intake passage and the movable passage in the conduit direction by means of the first communicating aperture and the second communicating aperture.

According to the present invention, because the communicating channel length between the air intake passage and the resonance chamber is adjusted by changing the position of overlap of the second communicating aperture relative to the first communicating aperture by moving the movable member in the conduit direction, it is not necessary to provide extra space for changes in the communicating channel length. In other words, the communicating channel length can be changed without changing the length of the communicating pipe. Furthermore, because the resonance frequency is changed by changing the communicating channel length, there are no constraints on the shape of the resonance chamber provided that a predetermined internal volume is ensured.

DETAILED DESCRIPTION OF THE PREFERRED EMBODIMENTS

Preferred embodiments of the present invention will now be explained with reference to the drawings.

Embodiment 1

Figure 1:
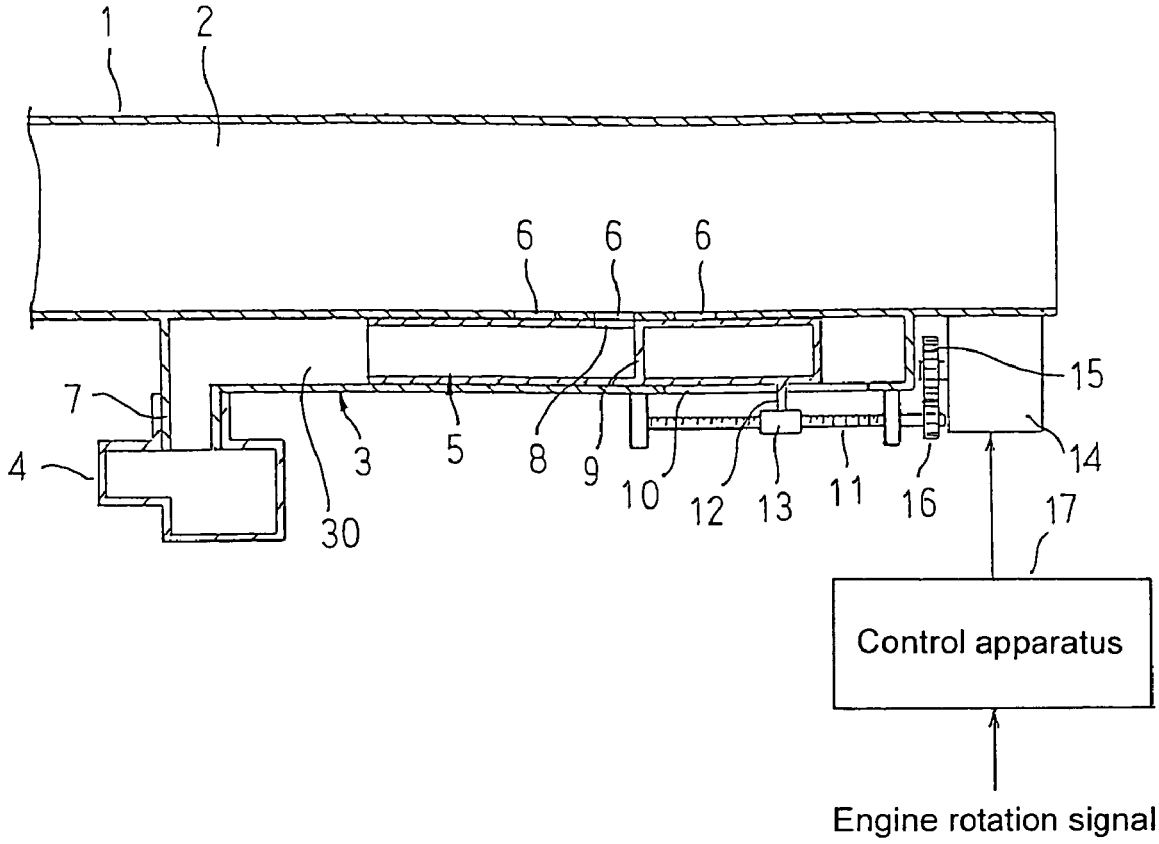
FIG. 1 is a cross section showing a mounted state of a variable resonator according to Embodiment 1 of the present invention.

FIG. 1 is a cross section showing a mounted state of a variable resonator according to Embodiment 1 of the present invention.

In FIG. 1, an air intake pipe 1 is formed so as to have a tube shape having a rectangular cross section, and is connected to an engine (not shown) so as to constitute an air intake passage 2. A variable resonator is configured such that a communicating pipe 3 is disposed on an outer periphery of the air intake pipe 1, a conduit 30 is formed inside the communicating pipe 3 so as to be parallel to the air intake passage 2, a resonance chamber 4 is mounted to a first end of the communicating pipe 3 so as to communicate with a first end of the conduit 30, and a movable member 5 is disposed so as to be movable in a conduit direction of the communicating pipe 3 by sliding in contact with an inner wall surface of the communicating pipe 3.

The communicating pipe 3 is mounted directly to an external surface of the air intake pipe 1, and forms the conduit 30 having a tube shape having a rectangular cross section by sharing an outer wall surface of the air intake pipe 1 as a portion of an inner wall surface. The conduit 30 is configured so as to have a rectilinear shape that is parallel to the air intake passage 2. A plurality of first communicating apertures 6 are disposed through the portion of the air intake pipe 1 constituting the inner wall surface of the communicating pipe 3 so as to be arranged in a single row at a predetermined spacing in the conduit direction. The first end of the conduit 30 is bent into an L shape, and opens onto a mounting portion 7 disposed so as to protrude from the first end of the communicating pipe 3. Moreover, a second end of the conduit 30 is sealed over.

The resonance chamber 4 is formed into an airtight space having a predetermined internal volume, and is mounted to the communicating pipe 3 by being fitted onto the mounting portion 7. Thus, the air intake passage 2 and the resonance chamber 4 communicate with each other by means of the first communicating apertures 6 and the conduit 30 (communicating pipe 3).

The movable member 5 is formed so as to have a tubular body having a rectangular cross section having an external shape matching an internal shape of the communicating pipe 3 so as to be able to move by sliding in contact with the inner wall surface of the communicating pipe 3. A single second communicating aperture 8 is disposed through a wall surface of the movable member 5 facing the outer wall surface of the air intake pipe 1 constituting the inner wall surface of the communicating pipe 3. A first end of the movable member 5 facing toward the first end of the conduit 30 is open, and a partitioning wall 9 is formed in a region where the second communicating aperture 8 is formed so as to separate a first end portion and a second end portion of the movable member 5. Thus, a movable passage is formed that extends from the second communicating aperture 8 through the movable member 5 to a first end opening of the movable member 5. The second communicating aperture 8 is formed so as to have a similar shape to that of the first communicating apertures 6, and is placed sequentially above the plurality of first communicating apertures 6 as the movable member 5 is moved from the first end to the second end of the conduit 30 of the communicating pipe 3 such that a communicating position between the air intake passage 2 and the movable passage moves in the conduit direction of the conduit 30. Thus, a communicating channel length extending from the air intake passage 2 through the first communicating apertures 6, the second communicating aperture 8, the movable passage, and the conduit 30 to the resonance chamber 4 is changed. In other words, a communicating channel length between the air intake passage 2 and the resonance chamber 4 is changed.

A driving means for the movable member 5 will now be explained.

An elongated guiding aperture 10 is disposed in a wall surface of the communicating pipe 3 facing the outer wall surface of the air intake pipe 1 so as to extend in the conduit direction of the communicating pipe 3. A screw-threaded rod 11 is mounted rotatably to an outer wall surface of the communicating pipe 3 so as align with the guiding aperture 10. A pin 12 disposed so as to protrude from the movable member 5 projects outward through the guiding aperture 10 and is fixed to an internal screw thread member 13 that is screwed onto the screw-threaded rod 11. In addition, a motor 14 is mounted to the air intake pipe 1, and a gearwheel 15 fixed to a motor shaft and a gearwheel 16 fixed to an end portion of the screw-threaded rod 11 intermesh with each other. A control apparatus 17 controls driving of the motor 14 such that the screw-threaded rod 11 can be driven so as to rotate. Torque from the screw-threaded rod 11 is converted to a rectilinear motive force by the internal screw thread member 13 such that the movable member 5 moves in the conduit direction inside the communicating pipe 3.

Moreover, the control apparatus 17 is constituted by a microcomputer made up of a CPU for performing predetermined data processing, a ROM in which motor drive data for obtaining desired resonance frequencies and programs executed by the CPU, etc., are stored as files, and a RAM in which results of the data processing by the CPU are stored, etc.

The driving means for the movable member 5 is not limited to this configuration provided that the movable member 5 can reciprocate in the conduit direction of the communicating pipe 3 and wires may also be mounted to two ends of the movable member 5 and the wires pulled by a motor, for example.

In a variable resonator configured in this manner, the second communicating aperture 8 is placed over one of the first communicating apertures 6 by moving the movable member 5 through the communicating pipe 3 (the conduit 30) in the conduit direction. Thus, the air intake passage 2 and the resonance chamber 4 communicate with each other as a communicating channel of length L. The communicating channel length L is changed by selecting which of the first communicating apertures 6 the second communicating aperture 8 is place over. Generally, if we let S be a cross-sectional area of the communicating channel, V be the internal volume of the resonance chamber 4, and C be the speed of sound, then the resonance frequency f is given by Expression (1).

Expression 1:

$$f = \frac{C}{2\pi}\sqrt{\frac{S}{VL}}$$

From the above expression, it can be seen that the resonance frequency f changes when the communicating channel length L is changed.

For example, when V=1000 cc and S=314 $mm^2$, if the communicating channel length L is changed from 10 mm to 150 mm, then the resonance frequency f changes from approximately 190 Hz to 75 Hz.

Next, a case in which this variable resonator is used in synchrony with engine rotational frequency will be explained.

Engine rotation signals obtained from a distributor, or a crank pulley, etc., for example, are input to the control apparatus 17. The control apparatus 17 reads the engine rotational frequency and calculates dominant frequency components of air intake noise at that time. A driving signal is sent to the motor 14 so as to obtain a resonance frequency corresponding to those frequency components. Thus, the motor 14 is driven to rotate so as to obtain a desired resonance frequency by moving the movable member 5 through the communicating pipe 3 by a predetermined distance in the conduit direction such that the second communicating aperture 8 is placed over a desired first communicating aperture 6.

The resonance frequency can be changed in synchrony with engine rotational frequency by making the control apparatus 17 perform the above operation constantly while the engine is operating.

According to Embodiment 1, because the communicating pipe 3 is disposed rectilinearly in contact with the outer periphery of the air intake pipe 1 with the conduit direction parallel to the air intake passage 2, the amount of protrusion of the variable resonator perpendicular to the air intake pipe 1 is reduced, enabling the variable resonator to be mounted without interfering with other with parts. Furthermore, because the outer wall surface of the air intake pipe 1 forms a portion of the inner wall surface of the communicating pipe 3, the amount of protrusion of the variable resonator perpendicular to the air intake pipe 1 is further reduced, enabling the variable resonator to be reduced in size and improving its mountability.

Because the communicating pipe 3 is mounted directly to the air intake pipe 1, transmitted noise from the air intake pipe 1 is reduced.

The plurality of first communicating apertures 6 are disposed through the air intake pipe 1 so as to be arranged in a single row in the conduit direction of the communicating pipe 3, the movable member 5 is disposed inside the communicating pipe 3 so as to be movable in the conduit direction, and the second communicating aperture 8 is disposed through the movable member 5 so as to be placed sequentially above the plurality of first communicating apertures 6 by the movement of the movable member 5. The communicating channel length L is changed by moving the movable member 5 so as to change the first communicating aperture 6 that the second communicating aperture 8 is placed above.

Here, the shape of the resonance chamber 4 can be arbitrarily changed provided that a predetermined internal volume is ensured. Thus, because there are no constraints on the shape of the resonance chamber 4, the shape of the resonance chamber 4 can be changed to fit the installation space, enabling the variable resonator to be mounted simply without interfering with other parts. Mounting design for air intake systems is also facilitated.

The communicating channel length L can be changed without changing a conduit length of the communicating pipe 3. Consequently, it is not necessary to provide extra space for changing the communicating channel length L.

Because the resonance chamber 4 is mounted by being fitted onto the mounting portion 7 formed on the first end of the communicating pipe 3, a variable resonator can be configured by selecting a resonance chamber having a shape conforming to vehicle types, engines, etc., having different mounting space constraints for air intake system parts. Thus, the air intake pipe 1, the communicating pipe 3, and the movable member 5 can be used as common parts, facilitating model development for different vehicle types, engine, etc.

Moreover, in Embodiment 1 above, a plurality of first communicating apertures 6 are formed so as to be arranged in a row so as to have a predetermined spacing in a conduit direction, but a single slot (communicating aperture) extending in a conduit direction may also be formed by linking a plurality of first communicating apertures 6 in a single row. In that case, because the communicating channel length can be changed continuously, the resonance frequency can be changed continuously, enabling air intake noise to be damped effectively.

Embodiment 2

Figure 2:
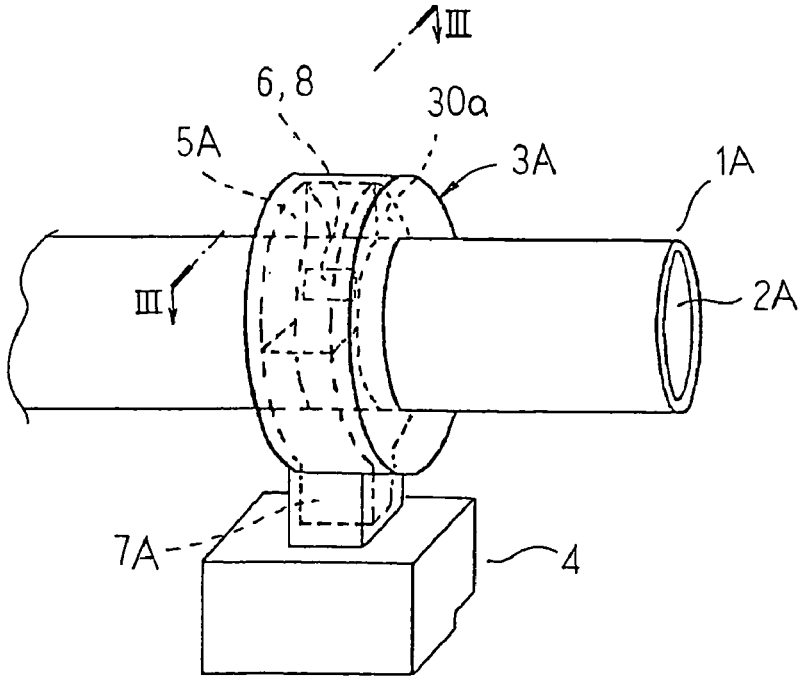
FIG. 2 is a perspective showing a mounted state of a variable resonator according to Embodiment 2 of the present invention.
Figure 3:
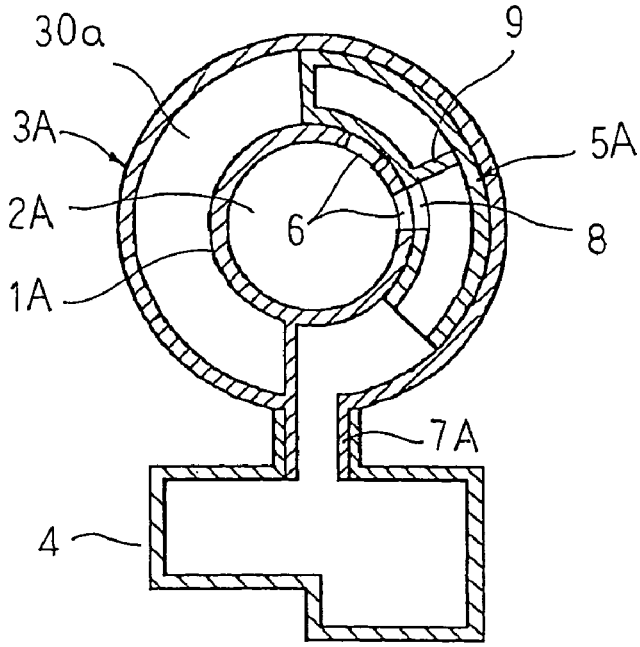
FIG. 3 is a cross section taken from line III-III in the direction of the arrows in FIG. 2.

FIG. 2 is a perspective showing a mounted state of a variable resonator according to Embodiment 2 of the present invention, and FIG. 3 is a cross section taken from line III-III in the direction of the arrows in FIG. 2.

In FIGS. 2 and 3, an air intake pipe 1A is formed so as to have a cylindrical shape. A communicating pipe 3A is mounted directly to an external surface of the air intake pipe 1A, and forms a conduit 30*a* having a tube shape having a rectangular cross section by sharing an outer wall surface of the air intake pipe 1A as a portion of an inner wall surface. The conduit 30*a* is configured so as to have an annular shape that is concentric to an air intake passage 2A. A plurality of first communicating apertures 6 are disposed through the portion of the air intake pipe 1A constituting the inner wall surface of the communicating pipe 3A so as to be arranged in a single row at a predetermined spacing in a conduit direction. A first end of the conduit 30*a* is bent radially outward into an L shape, and opens onto a mounting portion 7A disposed so as to protrude from an outer wall surface of the communicating pipe 3A. Moreover, a second end of the conduit 30*a* is sealed over.

A resonance chamber 4 is formed into an airtight space having a predetermined volume, and is mounted to the communicating pipe 3A by being fitted onto the mounting portion 7A. Thus, the air intake passage 2A and the resonance chamber 4 communicate with each other by means of the first communicating apertures 6 and the conduit 30*a* (communicating pipe 3A).

The movable member 5A is formed so as to have an arc-shaped tubular body having a rectangular cross section having an external shape matching an internal shape of the communicating pipe 3A (conduit 30*a*) and is disposed so as to be able to move in the conduit direction of the communicating pipe 3A by sliding in contact with the inner wall surface of the communicating pipe 3A. A single second communicating aperture 8 is disposed through a wall surface of the movable member 5A facing the outer wall surface of the air intake pipe 1A constituting the inner wall surface of the communicating pipe 3A. A first end of the movable member 5A facing toward the first end of the conduit 30*a* is open, and a partitioning wall 9 is formed in a region where the second communicating aperture 8 is formed so as to separate a first end portion and a second end portion of the movable member 5A. Thus, an arc-shaped movable passage is formed that extends from the second communicating aperture 8 through the movable member 5A to a first end opening of the movable member 5A. The second communicating aperture 8 is formed so as to have a similar shape to that of the first communicating apertures 6, and is placed sequentially above the plurality of first communicating apertures 6 as the movable member 5A is moved from the first end to the second end of the conduit 30*a* of the communicating pipe 3A such that a communicating channel length L between the air intake passage 2A and the resonance chamber 4 changes.

Moreover, the rest of this embodiment is configured in a similar manner to Embodiment 1 above.

Consequently, similar effects to those in Embodiment 1 above can also be achieved in Embodiment 2.

According to Embodiment 2, because the conduit 30*a* of the communicating pipe 3A is formed so as to have an annular shape concentric to the air intake passage 2A, the amount of protrusion perpendicular to the air intake pipe 1A is reduced, and length parallel to the air intake passage 2A is much shorter. Thus, the variable resonator can be configured compactly, further improving mountability.

Embodiment 3

Figure 4:
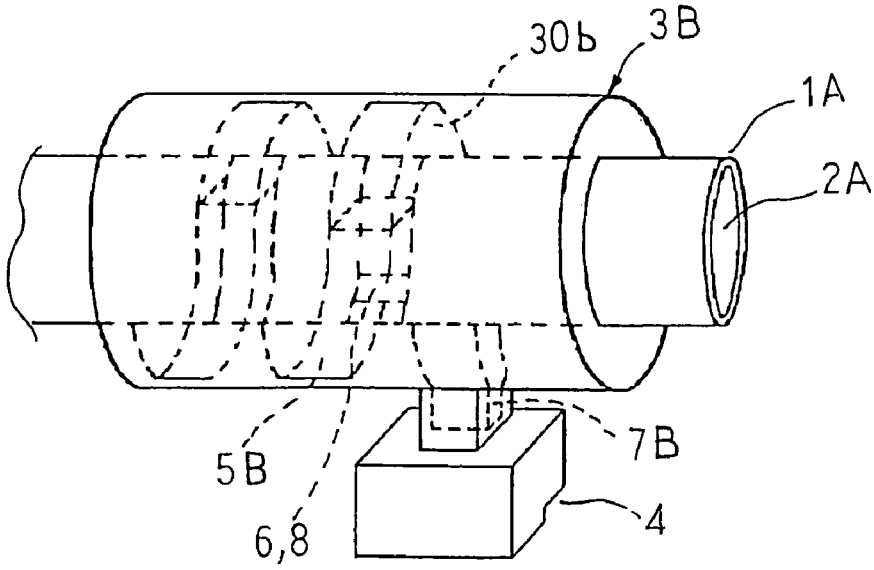
FIG. 4 is a perspective showing a mounted state of a variable resonator according to Embodiment 3 of the present invention.

FIG. 4 is a perspective showing a mounted state of a variable resonator according to Embodiment 3 of the present invention.

In FIG. 4, an air intake pipe 1A is formed so as to have a cylindrical shape. A communicating pipe 3B is mounted directly to an external surface of the air intake pipe 1A, and forms a conduit 30*b* having a tube shape having a rectangular cross section by sharing an outer wall surface of the air intake pipe 1A as a portion of an inner wall surface. The conduit 30*b* is configured so as to have a helical shape that is wound around an air intake passage 2A. A plurality of first communicating apertures 6 are disposed through the portion of the air intake pipe 1A constituting the inner wall surface of the communicating pipe 3B (conduit 30*b*) so as to be arranged in a single row at a predetermined spacing in a conduit direction. A first end of the conduit 30*b* is bent radially outward into an L shape, and opens onto a mounting portion 7B disposed so as to protrude from an outer wall surface of the communicating pipe 3B. Moreover, a second end of the conduit 30*b* is sealed over.

A resonance chamber 4 is formed into an airtight space having a predetermined volume, and is mounted to the communicating pipe 3B by being fitted onto the mounting portion 7B. Thus, the air intake passage 2A and the resonance chamber 4 communicate with each other by means of the first communicating apertures 6 and the conduit 30*b* (communicating pipe 3B).

The movable member 5B is formed so as to have a helical tubular body having a rectangular cross section having an external shape matching an internal shape of the conduit 30*b* (communicating pipe 3B) and is disposed so as to be able to move in the conduit direction of the conduit 30*b* by sliding in contact with the inner wall surface of the conduit 30*b*. A single second communicating aperture 8 is disposed through a wall surface of the movable member 5B facing the outer wall surface of the air intake pipe 1A constituting the inner wall surface of the conduit 30*b*. A first end of the movable member 5B facing toward the first end of the conduit 30*b* is open, and a partitioning wall (not shown) is formed in a region where the second communicating aperture 8 is formed so as to separate a first end portion and a second end portion of the movable member 5B. Thus, a helical movable passage is formed that extends from the second communicating aperture 8 through the movable member 5B to a first end opening of the movable member 5B. The second communicating aperture 8 is formed so as to have a similar shape to that of the first communicating apertures 6, and is placed sequentially above the plurality of first communicating apertures 6 as the movable member 5B is moved from the first end to the second end of the conduit 30*b* of the communicating pipe 3B such that a communicating channel length L between the air intake passage 2A and the resonance chamber 4 changes.

Moreover, the rest of this embodiment is configured in a similar manner to Embodiment 1 above.

Consequently, similar effects to those in Embodiment 1 above can also be achieved in Embodiment 3.

According to Embodiment 3, because the conduit 30*b* of the communicating pipe 3B is formed so as to have a helical shape that is wound around the air intake passage 2A, the variable range of the communicating channel length L between the air intake passage 2A and the resonance chamber 4 can be increased without excessively increasing length parallel to the air intake passage 2A. Thus, a compact variable resonator capable of reducing air intake noise over a wider frequency range can be achieved.

What is claimed is:

1. A variable resonator comprising:

a communicating pipe disposed on an outer periphery of an air intake pipe constituting an air intake passage of an engine, said communicating pipe having a conduit formed in an internal portion thereof so as to lie alongside an outer peripheral wall surface of said air intake pipe;

a resonance chamber mounted to said communicating pipe so as to communicate with a first end of said conduit;

a first communicating aperture disposed through said air intake pipe so as to communicate between said air intake passage and said conduit such that a plurality of said first communicating apertures are arranged in a single row in a conduit direction of said communicating pipe or such that said first communicating aperture extends in said conduit direction; and a movable member formed so as to have a tubular body having a movable passage extending from a second communicating aperture formed on a side wall to a first end opening, said movable member being disposed such that said side wall on which said second communicating aperture is formed faces said air intake pipe, such that said first end opening faces said first end of said conduit, and so as to be movable through said conduit in said conduit direction by sliding in contact with an inner wall surface of said communicating pipe, wherein:

a communicating channel length between said air intake passage and said resonance chamber is adjusted by changing a position of overlap of said second communicating aperture relative to said first communicating aperture by moving said movable member in said conduit direction so as to change a communicating position between said air intake passage and said movable passage in said conduit direction by means of said first communicating aperture and said second communicating aperture.

2. The variable resonator according to claim 1, wherein: said conduit is formed so as to have a rectilinear shape that is parallel to said air intake passage.

3. The variable resonator according to claim 1, wherein: said air intake pipe is formed so as to have a cylindrical shape; and said conduit is formed so as to have an annular shape that is concentric to said air intake passage.

4. The variable resonator according to claim 1, wherein: said air intake pipe is formed so as to have a cylindrical shape; and said conduit is formed so as to have a helical shape that is wound around said air intake passage.

* * * * *